US005543810A

United States Patent [19]

Park

[11] Patent Number: 5,543,810

[45] Date of Patent: Aug. 6, 1996

[54] COMMON APERTURE DUAL POLARIZATION ARRAY FED BY RECTANGULAR WAVEGUIDES

[75] Inventor: Pyong K. Park, Agoura Hills, Calif.

[73] Assignee: Hughes Missile Systems Company, Los Angeles, Calif.

[21] Appl. No.: 470,528

[22] Filed: Jun. 6, 1995

[51] Int. Cl.[6] ..... H01Q 13/12

[52] U.S. Cl. ..... 343/771; 343/770; 333/114

[58] Field of Search ..... 333/114; 343/727, 343/729, 730, 770, 771; H01Q 13/10, 13/12

[56] References Cited

U.S. PATENT DOCUMENTS

| | | | |
|---|---|---|---|
| 2,636,082 | 4/1953 | Saad | 333/114 |
| 3,518,576 | 6/1970 | Algeo | 333/114 |
| 3,537,037 | 10/1970 | Brumbaugh | 333/114 |
| 3,594,806 | 7/1971 | Black | 343/771 |
| 5,019,831 | 5/1991 | Yee et al. | 343/771 |
| 5,030,965 | 7/1991 | Park et al. | 343/770 |
| 5,210,543 | 5/1993 | Kultz | 343/771 |
| 5,270,724 | 12/1993 | Ajioka | 343/771 X |

*Primary Examiner*—Donald T. Hajec
*Assistant Examiner*—Tho Phan
*Attorney, Agent, or Firm*—Charles D. Brown; Wanda Denson-Low

[57] ABSTRACT

A dual polarization array that comprises horizontal polarization and vertical polarization arrays, combined with an efficient waveguide-fed standing wave feed array. The vertical polarization array comprises an offset, resonant, iris-fed, centered longitudinal-shunt-slot, standing wave array. The horizontal polarization array comprises a flared dipole fed by a longitudinal, shunt-slot, standing wave array. The waveguide-fed standing wave feed array is comprised of a plurality of waveguides that separately feed the horizontal polarization and vertical polarization arrays. The horizontal polarization array comprises a first plurality of radiating waveguides laterally disposed adjacent to each other that are separated by a first plurality of gaps. Each waveguide comprises a plurality of radiating flared dipoles disposed adjacent to a respective plurality of longitudinal radiating shunt slots. The vertical polarization array comprises a second plurality of radiating waveguides laterally disposed adjacent to each other that are separated by a second plurality of gaps. The second plurality of radiating waveguides are laterally offset from the first plurality of radiating waveguides. Each of the second plurality of radiating waveguides comprises a plurality of longitudinal shunt slots disposed in respective gaps between adjacent radiating waveguides of the horizontal polarization array, and an offset resonant iris centered on each respective longitudinal shunt slot that is oriented orthogonal thereto. A first feed waveguide includes a plurality of tilted series/series coupling slots for coupling horizontal polarization to the waveguides of the horizontal polarization standing wave array. A second feed waveguide comprises a plurality of shunt slots comprising iris loaded transverse series/shunt coupling slots for coupling vertical polarization to the waveguides of the vertical polarization standing wave array.

2 Claims, 3 Drawing Sheets

12a
12b
10
x
y
13
14
15
16
17
18
19
21
23
24

COMMON APERTURE DUAL POLARIZATION ARRAY FED BY RECTANGULAR WAVEGUIDES

The invention was made with Government support under contract awarded by Department of Defense. The Government has certain rights in this invention.

BACKGROUND

The present invention relates to antenna arrays, and more particularly, to a common aperture dual polarization array fed by rectangular waveguides.

Very high resolution seeker antennas, for example, require fully populated dual polarization antenna arrays. There are several kinds of dual-polarization seeker antenna arrays presently known that are used for such seeker antennas, and upon which the present invention improves. These include a reflector antenna array with a dual polarization feed. The reflector antenna array is bulky and its efficiency is low. Furthermore, reflector antenna array is very difficult to achieve low sidelobe array pattern.

A second antenna array is a patch array antenna. The patch antenna array is low cost and low profile, but its bandwidth of each element is extremely narrow that achieving high performance array with the patch element is very difficult. Also, the efficiency of the patch antenna array is poor.

A third antenna array is a combination antenna array comprising a shunt slot array fed by a rectangular waveguide that provides for vertical polarization, combined with a dipole array fed by a stripline that provides for horizontal polarization. This combination antenna array employs an efficient vertical polarization array, but the dipole array fed by the stripline is bulky. More particularly, control of the input impedance seen at the stripline of each dipole that is required to achieve a low sidelobe pattern is very difficult to achieve, and the overall input match of the array is also very difficult to achieve. However, phase matching between the vertical polarization array and the horizontal polarization array is difficult because each array uses a different transmission line.

Consequently, it is an objective of the present invention to provide for a common aperture dual polarization array fed by rectangular waveguides that improves upon the above-mentioned antenna arrays.

SUMMARY OF THE INVENTION

The present invention is a common aperture dual polarization array that comprises vertical polarization and horizontal polarization arrays, combined with an efficient waveguide-fed standing wave array. The vertical polarization array comprises an offset, resonant, iris-fed, centered longitudinal-shunt-slot, standing wave array. The horizontal polarization array comprises a flared dipole fed by a resonant iris fed centered longitudinal, shunt-slot, standing wave array. The waveguide-fed standing wave array is comprised of a plurality of waveguides that separately feed the vertical polarization and horizontal polarization arrays.

More particularly, the present invention is a common aperture dual polarization array comprising a horizontal polarization standing wave array, a vertical polarization standing wave array, and a plurality of feed waveguides. The horizontal polarization standing wave array comprises a first plurality of radiating waveguides laterally disposed adjacent to each other in a first layer that are separated by a first plurality of gaps, and wherein each waveguide comprises a plurality of radiating flared dipoles disposed adjacent to a respective plurality of resonant iris fed centered longitudinal radiating shunt slots. The vertical polarization standing wave array comprises a second plurality of radiating waveguides laterally disposed adjacent to each other in a second layer that are separated by a second plurality of gaps, and wherein the second plurality of radiating waveguides are laterally offset from the first plurality of radiating waveguides, and wherein each of the second plurality of radiating waveguides comprises a plurality of longitudinal shunt slots disposed in respective ones of the second gaps between adjacent radiating waveguides of the horizontal polarization array, and an offset resonant iris centered on each respective longitudinal shunt slot that is oriented orthogonal thereto. The first feed waveguide comprises a plurality of tilted series/series coupling slots that are adapted to couple horizontal polarization to the first layer of radiating waveguides of the horizontal polarization standing wave array. The second feed waveguide comprises a plurality of series slots comprising iris loaded transverse series/shunt coupling slots that are adapted to couple vertical polarization to the second layer of radiating waveguides of the vertical polarization standing wave array.

The present common aperture dual polarization antenna array has the following advantages compared to conventional dual polarization arrays. The dual-polarization antenna array is compact and has a low profile, and both arrays are highly efficient. Phase matching between the arrays of the dual polarization antenna array is simple because both arrays use the same kind of feed transmission line, namely a rectangular waveguide. The design of the dual polarization antenna array is relatively simple and provides a low sidelobe pattern because it is easy to achieve the desired aperture distribution using shunt radiating slots fed by the rectangular waveguides.

Current trends in RF seeker design emphasize the reduction of cost and volume while achieving high performance. The common aperture dual polarization array of the present invention provides a high performance and low profile dual polarization seeker antenna for use with medium to large-sized antenna arrays, and may be used in a variety of missile seekers.

BRIEF DESCRIPTION OF THE DRAWINGS

The various features and advantages of the present invention may be more readily understood with reference to the following detailed description taken in conjunction with the accompanying drawings, wherein like reference numerals designate like structural elements, and in which.

DETAILED DESCRIPTION

Figure 1:
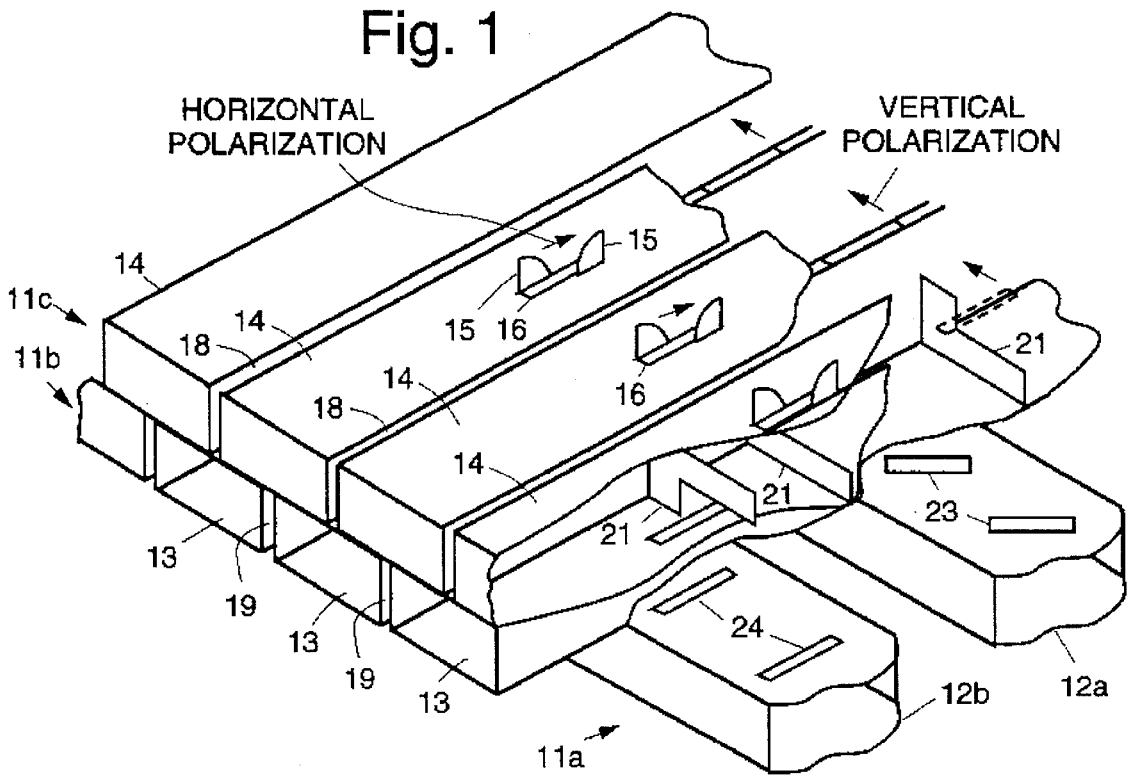
FIG. 1 shows a perspective view of a common aperture dual polarization array in accordance with the principles of the present invention.

Referring to the drawing figures, FIG. 1 shows a portion of a common aperture dual polarization array 10 in accordance with the principles of the present invention. The common aperture dual polarization array 10 is comprised of a plurality of waveguide layers identified as top, middle, and bottom waveguide layers 11*c*, 11*b*, 11*a*, respectively. The bottom waveguide layer 11*a* comprises a feed waveguide array 11*a* that includes a plurality of rectangular feed waveguides 12*a*, 12*b* for feeding electromagnetic energy to the top and middle waveguide layers 11*c*, 11*b*, respectively. The middle waveguide layer 11*b* forms a vertical polarization array 11*b* and is comprised of a plurality of rectangular radiating waveguides 13 disposed adjacent to each other that are separated by a second predetermined gap 19. The top waveguide layer 11*c* forms a horizontal polarization array 11*c* and is also comprised of a plurality of rectangular radiating waveguides 14 disposed adjacent to each other that are separated by a first predetermined gap 18.

The rectangular radiating waveguides 13, 14 of the top and middle waveguide layers 11*c* 11*b* are offset from each other and are generally aligned with each other. The rectangular radiating waveguides 14 of the top waveguide layer 11*c* each include a plurality of flared dipoles 15 respectively disposed adjacent to a plurality of iris fed centered longitudinal radiating shunt slots 16. Each of the plurality of flared dipoles 15 are fed by one of the iris fed centered longitudinal radiating shunt slots 16.

A plurality of iris fed centered longitudinal shunt slots 17 are formed in a top surface of each of the radiating waveguides 13 of the middle waveguide layer 11*b*, in each of the second predetermined gaps 18 between adjacent rectangular radiating waveguides 14 of the top waveguide layer 11*c*. An offset resonant iris 21 is disposed in each waveguide 13 of the middle waveguide layer 11*b* that is centered on the respective longitudinal shunt slots 17 disposed above it and oriented orthogonal to a longitudinal centerline of its respective adjacent slot 17. This will be shown in more detail in FIG. 3. The offset resonant iris 21 is also disposed above coupling slots 24 disposed in an upper surface of the rectangular feed waveguide 12*b* . This will be shown in more detail in FIG. 5.

Figure 2:
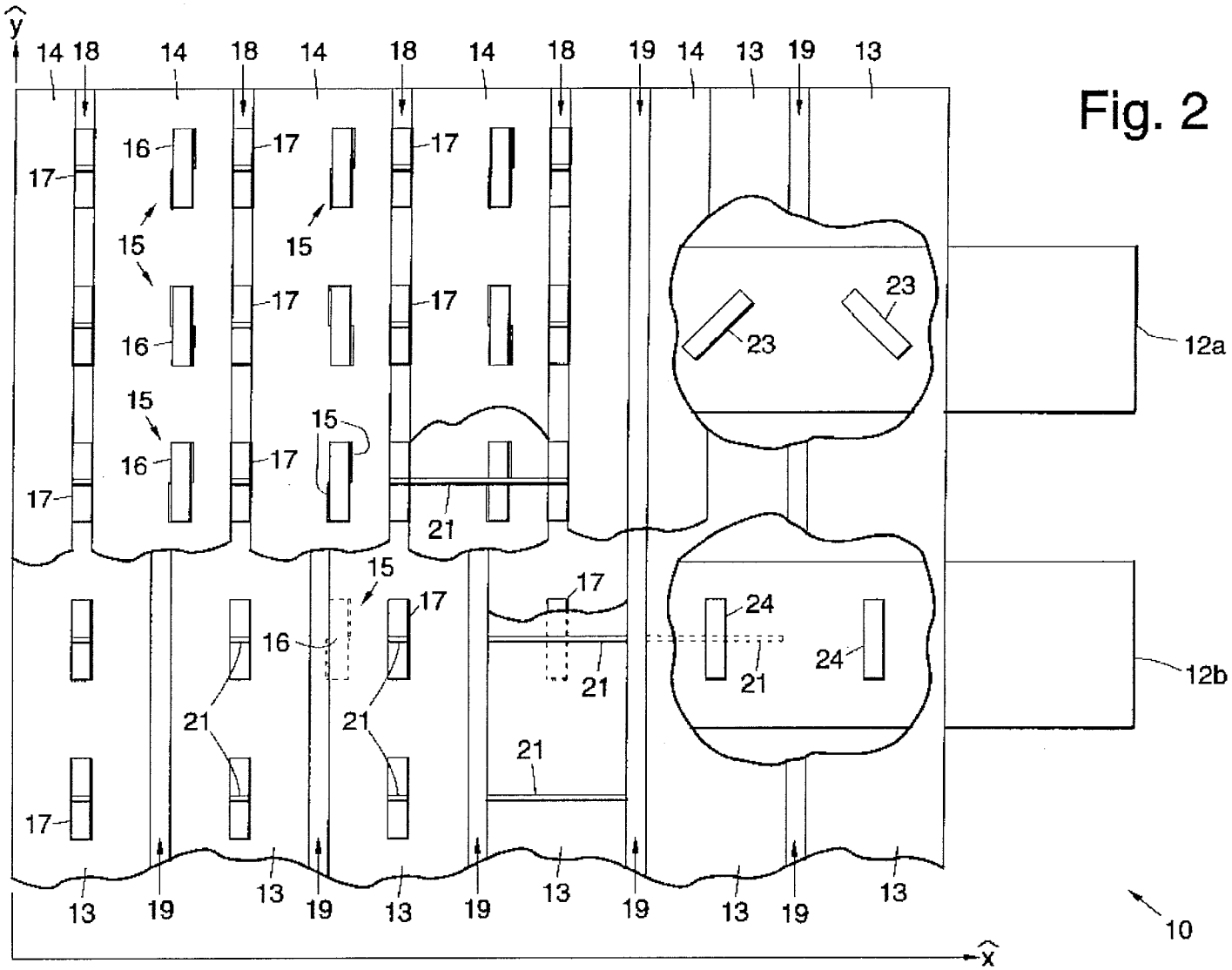
FIG. 2 shows a partially cutaway top view of the common aperture dual polarization array of FIG. 1.

In order to better understand the construction of the present invention, reference is made to FIG. 2, which shows a partially cutaway top view of the common aperture dual polarization array 10 of FIG. 1, which shows the relative locations of the various elements of the array 10 with more clarity. Portions of three radiating waveguides 14 of the upper waveguide layer 11*c* are shown illustrating the relative locations of the radiating shunt slots 16 (offset from the centerline of the radiating waveguides 14) and the plurality of flared dipoles 15 disposed adjacent the respective radiating shunt slots 16. Several waveguides 13 of the middle waveguide layer 11*b* are shown, and the relative locations of the iris fed centered longitudinal shunt slots 17 disposed in each second predetermined gap 18 is shown. The location of the iris 21 relative to each centered longitudinal shunt slot 17 is shown. One waveguide 13 is cut away to expose the inside thereof and shows the locations of the centered longitudinal shunt slots 17 disposed therein. The rectangular feed waveguides 12*a*, 12*b* that feed energy to the top and middle waveguide layers 11*c*, 11*b* are partially cut away to expose the insides thereof and show the respective coupling slots 23, 24 and offset resonant iris 21 disposed therein. Several elements are shown in phantom in FIG. 2 and represent locations of elements disposed above an underlying component in order to more clearly show the respective positions of the elements of the array 10.

Figure 3:
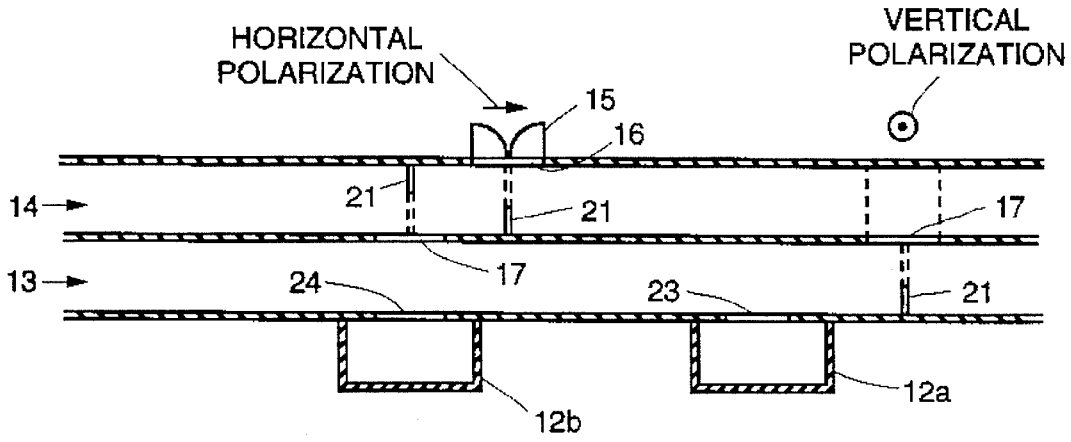
FIG. 3 is a side view of a portion of the common aperture dual polarization array of FIG. 1.

FIG. 3 is a side view of a portion of the common aperture dual polarization array 10 of FIG. 1. More particularly, FIG. 3 shows the offset resonant iris 21 disposed in the radiating waveguide 13 for the top and middle waveguide layers 11*c*, 11*b* that is used to feed the centered longitudinal radiating slots 17 of the radiating waveguides 14. Each iris 21 has an L-shape. Each L-shaped iris 21 is centered relative to its adjacent longitudinal radiating slot 17. The predetermined gap 18 between the radiating waveguides 13 of the top layer 11*a* have the plurality of radiating slots 17 formed therein that are aligned with the plurality of offset resonant iris-fed centered longitudinal radiating slots disposed in the waveguides 13 below. The plurality of slots allow horizontally polarized radiation to emanate from the common aperture dual polarization array 10.

Figure 4:
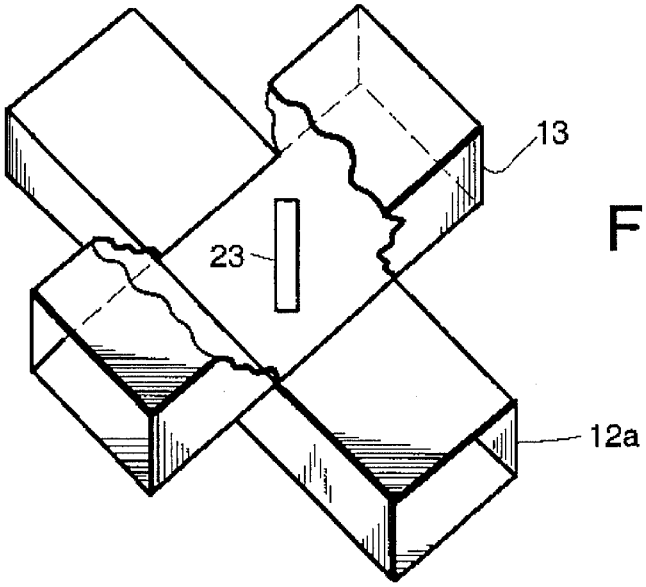
FIG. 4 illustrates a perspective view of a tilted series/series coupling slot disposed between crossed feed and radiating rectangular waveguides of the common aperture dual polarization array of FIG. 1.

Each of the plurality of rectangular feed waveguides 12*a*, 12*b* forming the bottom waveguide layer 11*a* is comprised of a plurality of coupling slots 23, 24. One of the rectangular feed waveguides 12*a* has a plurality of slots 23 comprising tilted series/series coupling slots 23 disposed therein that are adapted to couple horizontal polarization to the radiating waveguides 13 of the second layer 12*b*. The details of the tilted series/shunt coupling slots 23 of the rectangular waveguide 12*a* is discussed with reference to FIG. 4. FIG. 4 illustrates the tilted series/series coupling slot 23 disposed between crossed feed and radiating rectangular waveguides 12*a*, 13 comprising the common aperture dual polarization array of FIG. 1.

Figure 5:
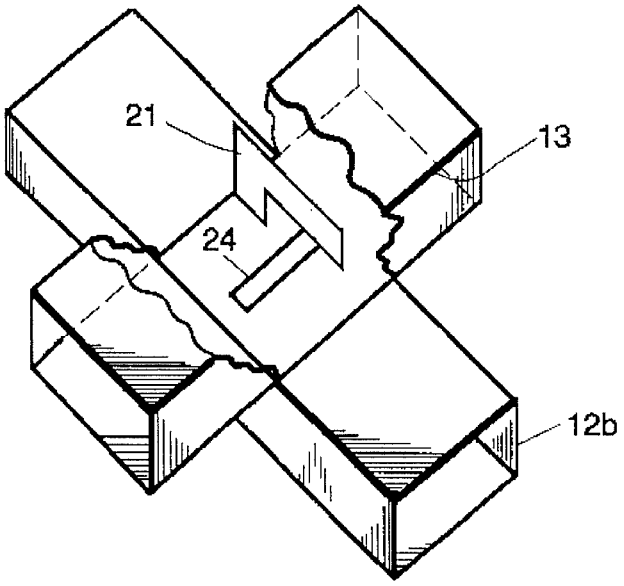
FIG. 5 illustrates a perspective view of crossed rectangular feed and radiating waveguides of the common aperture dual polarization array of FIG. 1 that include a transverse series/shunt coupling slot disposed in the rectangular feed waveguide and an offset resonant iris disposed in the radiating waveguide.

The other of the rectangular feed waveguides 12*b* has a plurality of shunt slots 24 comprising iris loaded transverse series/shunt coupling slots 24 disposed therein that are adapted to couple vertical polarization to the radiating waveguides 14 of the first layer 12*a*. The details of the iris loaded transverse series/shunt coupling slots 24 of the rectangular feed waveguide 12*b* is discussed with reference to FIG. 5. FIG. 5 illustrates crossed rectangular feed and radiating waveguides 12*b*, 13 comprising the common aperture dual polarization array of FIG. 1 that include the transverse series/shunt coupling slot 24 disposed in the rectangular feed waveguide 12*b* and the offset resonant iris 21 disposed in the rectangular radiating waveguide 13.

In the common aperture dual polarized array 10, its entire aperture is used to provide for a vertical polarization and horizontal polarization arrays. A highly efficient standing wave array is produced using the plurality of flared dipoles 15 and the plurality of shunt slots 16 in the rectangular waveguides 14 of the top waveguide layer 11*a*. Each flared dipole 15 is fed by a corresponding longitudinal shunt slot 16 and its polarization is orthogonal to the polarization of the longitudinal shunt slot 16. The excitation of the flared dipole 15 is controlled by the offset of the longitudinal shunt slot 16 from a centerline of the rectangular waveguide 14.

Therefore, the common aperture dual polarized array 10 in accordance with the principles of the present invention may be constructed as follows. The horizontal polarization array is a planar array formed by the flared dipoles 15 fed by the iris fed centered longitudinal shunt slots 16 disposed in the rectangular waveguides 14. The horizontal polarization array comprises the top waveguide layer 11*c* shown in FIG. 1. The gap 18 between the radiating waveguides 13 is provided in the horizontal polarization array comprising the middle waveguide layer 11*b* to provide a radiation path for energy radiated by the vertical polarization array. The vertical polarization array comprises the middle layer 11*b* and comprises an offset resonant iris-fed centered longitudinal shunt slot standing wave array as shown in FIG. 1. Since the radiating longitudinal shunt slots 17 for the vertical polarization array are collinear at the centerline of the radiating rectangular waveguides 13, each radiating slot 17 is fed by the offset resonant iris 21 as shown in FIG. 3. The excitation of the centered longitudinal shunt slot 17 may be controlled by the offset amount of the resonant iris 21.

The waveguide feed arrangement for both arrays will now be described in more detail. The vertical polarization array is fed by the tilted series/series coupling slots 23 disposed in the crossed-feed rectangular waveguide 12*a* shown in FIG. 4. On the other hand, the horizontal polarization array is fed by the offset resonant iris-loaded transverse series/shunt coupling slots 24 disposed in the crossed-feed rectangular waveguide 12*b* so that the transverse feed slot 17 is connected to the radiating horizontal polarization array by way of the gap 19 between the vertical polarization radiating waveguides 13 as shown in FIG. 5. The offset resonant iris 21 in the horizontal polarization radiating waveguides 13 provides for excitation of the transverse series/shunt coupling slot 24 because the coupling slot 24 is longitudinally located at the center of the radiating slot 17.

Figure 6:
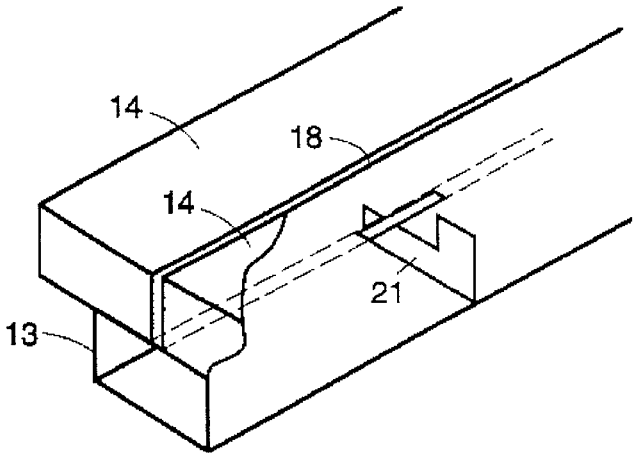
FIG. 6 shows a partially cutaway perspective view of an offset resonant iris for feeding a centered longitudinal radiating slot in a radiating waveguide of the dual polarization array of FIG. 1.

FIG. 6 shows a partially cutaway perspective view of the offset resonant iris 21 for feeding the centered longitudinal radiating slot 17 in the radiating waveguide 13 of the dual polarization array 10 of FIG. 1. The resonant iris 21 is offset with respect to the centered longitudinal radiating slot 17, and the slot 17 is disposed in the second predetermined gap 18 between the rectangular radiating waveguides 14.

Thus there has been described a new and improved common aperture dual polarization array fed by rectangular waveguides. It is to be understood that the above-described embodiment is merely illustrative of some of the many specific embodiments which represent applications of the principles of the present invention. Clearly, numerous and other arrangements can be readily devised by those skilled in the art without departing from the scope of the invention.

What is claimed is:

1. A common aperture dual polarization array comprising:

a horizontal polarization standing wave array comprising a first plurality of radiating waveguides laterally disposed adjacent to each other in a first layer that are separated by a first plurality of gaps, and wherein each waveguide comprises a plurality of radiating flared dipoles disposed adjacent to a respective plurality of longitudinal radiating shunt slots;

a vertical polarization standing wave array that comprises a second plurality of radiating waveguides laterally disposed adjacent to each other in a second layer that are separated by a second plurality of gaps, and wherein the second plurality of radiating waveguides are laterally offset from the first plurality of radiating waveguides, and wherein each of the second plurality of radiating waveguides comprises a plurality of longitudinal shunt slots disposed in respective ones of the second gaps between adjacent radiating waveguides of the horizontal polarization array, and an offset resonant iris centered on each respective longitudinal shunt slot that is oriented orthogonal thereto; and a feed waveguide array comprising a first feed waveguide comprising a plurality of tilted series/series coupling slots for coupling horizontal polarization to the first plurality of radiating waveguides of the horizontal polarization standing wave array, and a second feed waveguide comprising a plurality of shunt slots comprising iris loaded transverse series/shunt coupling slots for coupling vertical polarization to the second plurality of radiating waveguides of the vertical polarization standing wave array.

2. The common aperture dual polarization array of claim 1 wherein the first and second pluralities of radiating waveguides each comprise rectangular radiating waveguides.

* * * * *